United States Patent [19]

Stevenson

[11] 4,354,631

[45] Oct. 19, 1982

[54] RESEALABLE ENVELOPE

[75] Inventor: Mayne B. Stevenson, Park Ridge, Ill.

[73] Assignee: Arvey Corporation, Chicago, Ill.

[21] Appl. No.: 252,447

[22] Filed: Apr. 9, 1981

[51] Int. Cl.[3] ..... B65D 27/04; B65D 27/06

[52] U.S. Cl. ..... 229/71; 53/386; 53/387; 229/73

[58] Field of Search ..... 229/73, 71; 53/386, 53/387

[56] References Cited

U.S. PATENT DOCUMENTS

| | | | |
|---|---|---|---|
| 932,715 | 8/1909 | Morrison | 229/73 |
| 1,148,433 | 7/1915 | Benedict | 229/71 |
| 1,245,447 | 11/1917 | Felenchak | 229/73 |
| 2,417,050 | 3/1947 | Baluk | 229/73 |
| 2,485,040 | 10/1949 | Cupo | 53/387 |
| 3,368,321 | 2/1968 | Suther et al. | 53/386 |
| 3,380,648 | 4/1968 | De Lyra | 229/73 |
| 3,381,447 | 5/1968 | Ash et al. | 53/386 |
| 3,498,528 | 3/1970 | Klein | 229/73 |
| 3,558,040 | 1/1971 | Krueger | 229/73 |
| 3,802,618 | 4/1974 | Wiessner | 229/73 |
| 4,180,168 | 12/1979 | Hiersteine | 229/73 |
| 4,190,161 | 2/1980 | Gendron | 229/71 |

FOREIGN PATENT DOCUMENTS

| | | | |
|---|---|---|---|
| 26331 | of 1904 | United Kingdom | 229/73 |
| 3476 | of 1912 | United Kingdom | 229/73 |
| 383748 | 11/1932 | United Kingdom | 229/71 |

*Primary Examiner*—Stephen P. Garbe

*Attorney, Agent, or Firm*—Dressler, Goldsmith, Shore, Sutker & Milnamow, Ltd.

[57] ABSTRACT

An improved envelope arrangement which is readily adaptable for resealing and reuse after an initial sealing and use. The envelope arrangement includes inner and outer flap portions and defines a pouch-like pocket portion for insertion of materials therein. The envelope may be used initially by sealing of the outer flap portion, which is readily openable and removable by the recipient of the envelope. The recipient may then reuse the envelope by again sealing it by use of the inner flap portion.

3 Claims, 5 Drawing Figures

FIG. 1
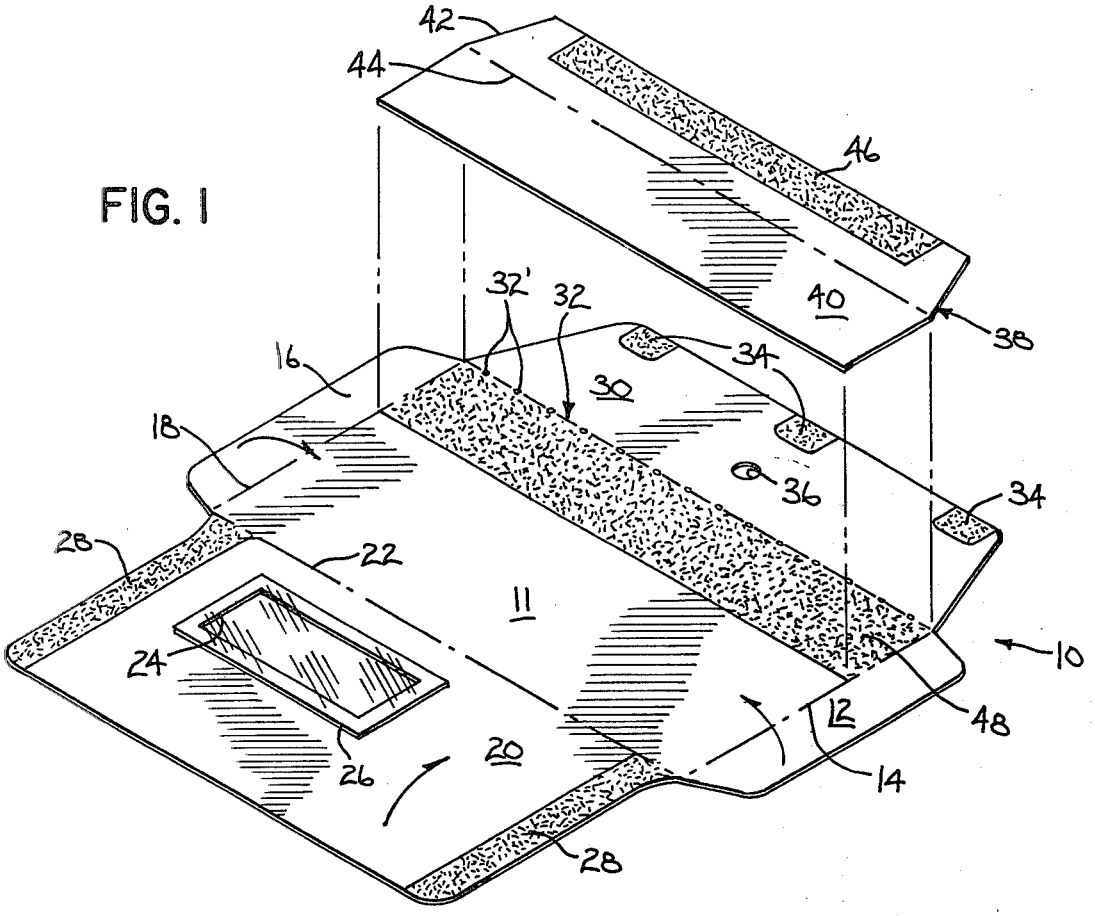
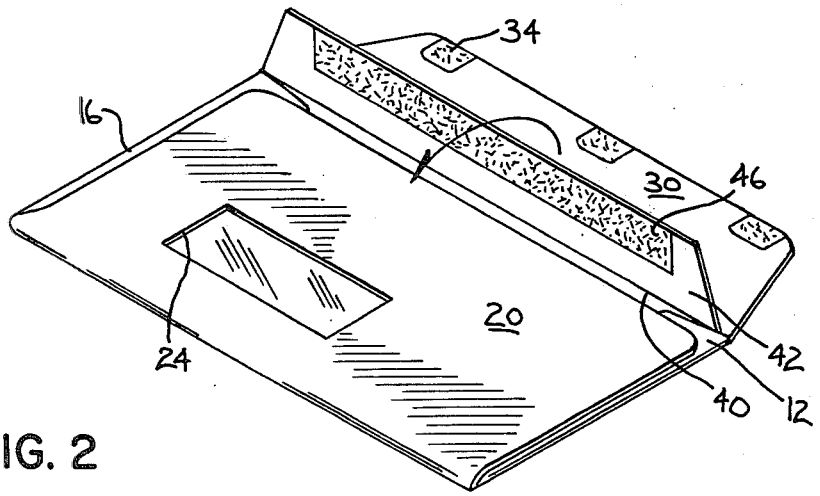
FIG. 2

RESEALABLE ENVELOPE

BACKGROUND OF THE INVENTION

This invention relates generally to sealable envelopes and more particularly to a unique envelope arrangement which includes inner and outer sealing flaps whereby the envelope may be reused and resealed after its initial sealing and opening.

In the delivery of good and rendering of services to customers, it is commonly the practice to periodically prepare statements of accounts or billings, and insert the statement in an envelope and mail that to the customer or purchaser. In conducting business in this manner, a considerable expenditure is made in preparing the statements, inserting the statements in the envelope and sealing the envelopes. Of significance is that the speed with which the bills are paid or replied to is greatly enhanced by the presence of a return envelope in the hands of the customer. In view of this, it is commonly the practice to insert such a return envelope with the statement in the first envelope, necessitating additional expenditure of time, labor, materials as well as possibly increasing postage fees. If the customer is required to provide the return envelope for payment of the bill, there is also an increase in the chance of the return payment being mis-addressed and thereby being lost or misrouted by the post office department, further increasing the time and expense of account collection. Thus, it is desirable to provide the customer with some type of return mailing envelope for the convenience of the customer and for enhancing the speed of return payment receipt. However, it would be extremely desirable if this could be accomplished without the necessity of including a separate return envelope along with the initial statement so that a savings in mailing and material costs and time and energy could be achieved.

SUMMARY OF THE INVENTION

The subject invention provides a novel envelope arrangement which provides the user with the advantages of the inclusion of a return envelope without the attendant additional expense. This is accomplished in a unique way by fashioning an envelope which may be reused, that is, sealed an initial time and mailed, then opened, resealed and mailed again. The advantages of such an arrangement are readily apparent in that a single envelope may now perform the function of two separate envelopes. Clearly, not only does this provide substantial savings for the user, but also provides a convenience for the recipient of the initial mailing since that person need no longer provide and address a return envelope for mailing to the initial sender. Additionally, the construction of the envelope arrangement of the subject invention is very simple and straightfoward so that production costs may be kept at a minimum.

The subject invention comprises a unitary panel member constructed of a suitable paper or cardboard material, although other materials may of course be used. The unitary panel member includes a plurality of score lines which define a central panel, a pair of side flaps hinged to one opposed pair of edges of the central panel, and a front panel portion hinged to one of the remaining opposed edges of the central panel. The unitary member further includes an outer flap portion removably hinged along the remaining opposed edge of the central panel which is separated therefrom by both a score line which includes perforations. A suitable window or cutout is provided in the front panel portion of the unitary member which may be covered with a transparent film from the inside.

The subject envelope arrangement further includes an inner flap panel which includes an inner panel portion and an inner flap portion divided by a score line. In order to form the envelope arrangement for use, the inner panel portion of the inner flap panel is glued or otherwise adhered to the central panel portion of the unitary panel member such that the score line of the inner flap panel is parallel and adjacent to the score line, which may also be perforated, provided between the central panel portion and the outer flap portion of the unitary panel member. The panel portion of the inner flap panel is glued to the unitary member such that the inner flap portion and the outer flap portion are generally adjacent to each other. Suitably, the outer flap portion is longer than the inner flap portion. Once this step has been accomplished, the remaining portions of the unitary panel member are folded and assembled in a conventional fashion. Each of the side flaps are folded inwardly of the central panel along their respective score lines, and the front panel portion folded inwardly thereafter and suitably gluded or adhered to each of the inwardly folded side flap portions. It will be appreciated that an envelope arrangement has now been provided which includes a conventional pouch-like pocket portion for insertion of materials to be mailed, while also including inner and outer flap portions, each including suitable adhesive or gum material for use as follows.

Upon the initial mailing or use of the envelope, the materials to be sent are inserted into the envelope such that the address of the recipient is viewable through the window provided in the front panel portion of the envelope. The envelope is then sealed using the outer flap portion only. Because the inner flap portion is shorter than the outer flap portion, both flap portions are folded over so that they overlie the front panel portion of the envelope. The envelope is then sealed using the adhesive or gum of the outer flap portion only, in this way preserving the freshness and sealing capabilities of the inner flap portion which is disposed beneath the outer flap portion after it is sealed. Suitable postage may then be affixed at this time, and the envelope mailed to the intended recipient. It should be noted that many firms provide postage by metering or through the use of a postage permit number, either of which may be provided on the outer flap portion of the envelope.

When the envelope is received by the recipient, the outer flap portion is detached from the front panel portion so that the envelope may be opened and the contents removed. By providing appropriate selected amounts of adhesive material on the outer flap portion, opening of this flap without undue damage to the front panel portion of the envelope may be easily accomplished. The outer flap portion may also be printed with instructions for the ease and convenience of the recipient in properly opening the envelope so that it may be reused. After the envelope has been opened and its contents removed, the recipient may then reuse the envelope by inserting the material to be mailed, such as payment for a bill received in the initial use of the envelope, and by positioning a suitable return portion of the statement initially sent such that the address of the initial sender will show through the window provided in the front panel portion of the envelope. The recipient then removes the outer flap portion of the envelope by tearing it along the perforation provided, and discards this portion of the envelope. The envelope may then be easily resealed by using the gummed inner flap portion, and the envelope is then ready to be remailed. Clearly, the savings in labor, materials, and postage by use of the novel envelope structure disclosed herein is readily apparent, which also provides a great convenience to the recipient who need not provide a return envelope for returning payment or the like to the initial sender.

BRIEF DESCRIPTION OF THE DRAWINGS

FIG. 1 is a perspective view of the envelope arrangement of the subject invention before it is assembled and folded into its finished form;

FIG. 2 is a perspective view illustrating the envelope of FIG. 1 after it has been assembled and folded and is ready for its initial use or mailing;

DESCRIPTION OF THE PREFERRED EMBODIMENT

Figure 3:
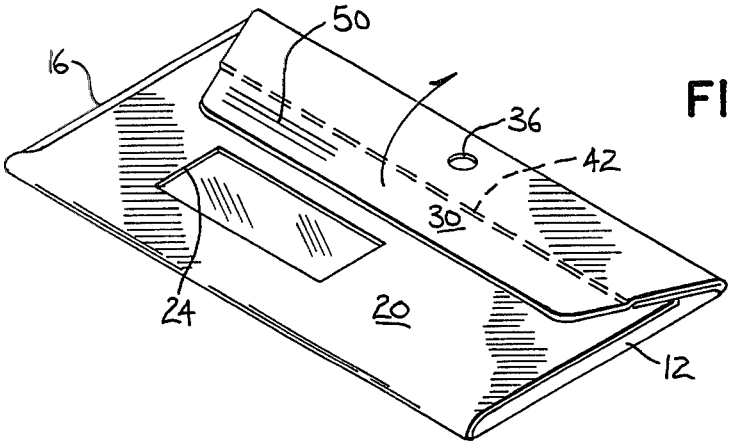
FIG. 3 is a perspective view of the envelope of FIG. 1 after it has been initially sealed and is ready to be initially opened by its recipient.
Figure 4:
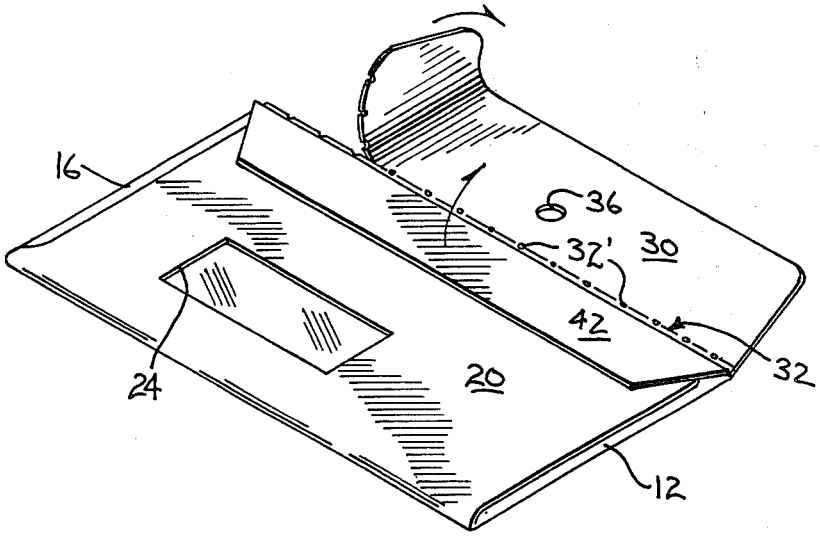
FIG. 4 is a perspective view of the envelope of the subject invention after the outer flap thereof has been opened and is being removed therefrom.
Figure 5:
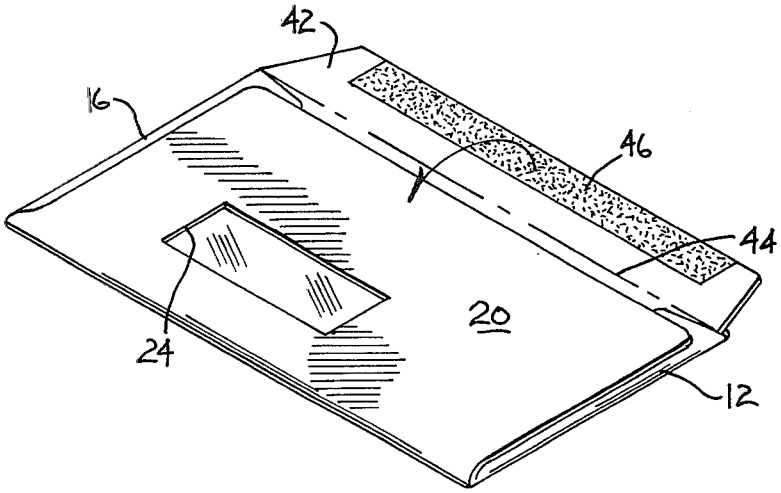
FIG. 5 is a perspective view of the envelope arrangement of the subject invention ready for resealing and reuse.

While the subject invention is susceptible to embodiment in different forms, there is shown in the drawings and will hereinafter be described a preferred embodiment with the understanding that the present disclosure is to be considered as an exemplification of the principles of the invention and is not intended to limit the invention to the embodiment illustrated.

With reference now to FIG. 1, there is shown the envelope arrangement of the subject invention prior to its folding and assembly. The envelope comprises a first unitary panel member 10 of paper, cardboard or other material suitable for envelope manufacture which may be economically formed on a suitable web machine and die-cut as is well known in the art. The panel member 10 includes a central panel or body portion 11 and suitable portions depending from each side of central panel 11. A side flap portion 12 is provided along one side of central panel 11 and is defined therefrom by a score line 14. A similar side flap portion 16 is provided along the opposite edge of central panel 11, and is defined by a score line 18. A front panel portion 20 is provided, and is separated from central panel 11 by a score line 22. In the preferred embodiment, front panel portion 20 includes a cutout or window 24 for affording ready observation of address information which may be positioned in the envelope in alignment therewith. The window 24 may optionally be covered with a transparent film 26 for the protection of contents within the envelope. A suitable adhesive material 28 may be applied as shown to opposite edge portions of front panel portion 20 for adhering the front panel portion 20 to side flap portions 12 and 16 after folding to the envelope along the score lines.

The unitary panel member 10 further includes an outer flap portion 30 defined along another edge portion of central panel 11 by a score line 32 (which in the embodiment shown includes perforations 32'. If desired, perforations 32' may be spaced from the score line 32. The outer flap portion 30 is provided with quantities of a suitable adhesive material or gum 34, and may also include a suction hole or cutout 36, the purpose of which will hereinafter be explained.

In order to form the reuseable envelope arrangement of the subject invention, an inner flap panel 38 is provided as shown. The inner flap panel 38 includes an inner panel portion 40 and an inner flap portion 42 defined and divided from one another by a score line 44. The inner flap portion 42 is provided with suitable adhesive or gum 46 which is for resealing the envelope during its second or reuse.

In one method of fabricating the envelope of the invention, the unitary panel member 10 is arranged generally as illustrated in FIG. 1. The inner flap panel 38 is then applied and securely affixed to the panel member 10 by a suitable adhesive material 48 such that the inner panel portion 40 overlies and is affixed to a marginal edge portion of central panel 11 such that score line 44 of the inner flap panel 38 is parallel and adjacent to, or overlying the score line 32. After this has been accomplished, each of side flap portions 12 and 16 are folded inwardly along their score lines as indicated by the arrows in FIG. 1 so that they are in overlapping relation to the central panel portion 11. Front portion 20 is then folded inwardly as indicated by the arrows in FIG. 1 and affixed to each of the side flaps 12 and 16 by the adhesive material 28. After this has taken place, the envelope would appear as in FIG. 2. The front panel portion 20 overlies and is affixed to each of the side flap portions 12 and 16, and together with the central panel 11 define a pouch or pocket for the insertion and carrying of materials to be delivered. It will be observed that the envelope structure provided herein includes two flap portions, an outer flap portion 30, and an inner flap portion 42. It will be appreciated that the outer flap portion 30 is longer and dimensionally larger than the inner flap portion 42 so that the outer flap portion 30 may be used for sealing the envelope during its initial use without detriment to inner flap portion 42.

As shown in FIG. 2, the envelope arrangement is ready fo use. The materials to be sent, such as a statement of account or billing, are easily insertable into the pocket defined by side flap portions 12 and 16, front panel portion 20, and central panel 11. the materials inserted within the envelope should include address information for the recipient of the envelope such that this information is observable through the window 24 provided in the front panel portion 20. In order to minimize handling expenses, the hole or cutout 36 provided in the outer flap portion 30 facilitates use of the envelope with automatic inserting machines so that such a machine is able to open both the inner flap 42 and the outer flap 30 by a suitable suction device applied to the outer surface of the outer flap portion 30 only. After the materials to be mailed have been inserted within the envelope, the outer flap portion 30 is folded over along score line 32, and affixed to the front panel portion 20 by adhesive or gum 34, or other appropriate sealing means. The envelope and its contents are now ready for mailing and generally have an appearance as illustrated in FIG. 3. Significantly, inner flap portion 42 (shown in phantom in FIG. 3) is maintained in a fresh and undamaged condition beneath outer flap portion 30. Suitable postage may be affixed to outer flap portion 30 of the envelope at this time, or the unitary panel member 10 from which the envelope has been fabricated may be printed with appropriate postage permit numbers or metered for postage during fabrication of the envelope.

Upon receipt of the envelope by the recipient, outer flap portion 30 is opened, as illustrated in FIG. 3. For the convenience of the recipient of the envelope, suitable opening instructions 50 may be provided on the outer flap portion 30 of the envelope. By providing the outer flap portion 30 with an appropriate quantity of adhesive 34 during manufacture, the flap portion 30 may be opened with minimal damage or marring of the front panel portion 20 of the envelope. After the outer flap portion 30 has been opened, the inner flap portion 42 is easily moved out of the way since its adhesive 46 has remained fresh and unused. The contents of the envelope may now be removed by the recipient.

In order for the recipient of the envelope to reuse it, the outer flap portion 30 is easily and conveniently removed by tearing along score line 32, the ease of removal being enhanced by inclusion of perforations 32'. By removing the outer flap portion 30, the cancelled postage affixed or printed thereon is also removed so that the recipient has what would appear to be a "new" envelope which would be free of any used postage, cancellation marks, etc.

After the outer flap portion 30 has been removed, the recipient inserts the material to be returned to the initial sender within the envelope. For the convenience of the recipient, the initial sender may include suitable address information on a return portion of the statement or the like such that it is readily observable through the window 24 provided in front panel portion 20 of the envelope. The envelope may now be conveniently resealed by folding inner flap portion 42 along its score line 44 and sealing it to the front panel portion 20 by means of the adhesive 46. The inner flap portion 42 may be preprinted with suitable spaces for filling in return address information and/or for affixing postage thereto. After suitable new postage is applied to the envelope, it may then be conveniently remailed with significant savings in effort and cost for both the initial sender and the recipient.

Thus, it will be appreciated that the subject invention provides a novel reuseable and resealable envelope arrangement which is readily adaptable for the sending of statements of accounts for billings or the like and for return mailing of corresponding payment or replies.

From the foregoing, it will be observed that numerous variations and modifications may be affected without departing from the true spirit and scope of the novel concept of the subject invention. It will be understood that no limitation with respect to the specific embodiment illustrated herein is intended or should be inferred. It is, of course, intended to cover by the appended claims all such modifications as fall within the scope of the claims.

What is claimed is:

1. A resealable envelope adapted for use with an automatic inserting machine, comprising:

a unitary sheet cut, scored and folded to define a rectangular central panel, a pair of side flaps respectively hinged to one opposed pair of edges of said central panel and folded over and against said central panel, a front panel hinged to one of the remaining opposed edges of said central panel and folded over and against said side flaps and adhered thereto and including a window therein for viewing the contents of said envelope, said central panel, side flaps, and front panel defining a pocket for the contents of the envelope, said unitary sheet further defining an outer sealing flap removably hinged to the remaining opposed edge of the central panel adapted to be folded over and adhered with adhesive means directly to a portion of said front panel disposed between said window and the remaining opposed edge of the central panel for initially sealing said envelope, said adhesive means accommodating detachment of said outer sealing flap from said front panel for opening said envelope without undue damage to said front panel, and means for resealing the pocket after said outer sealing flap has been removed including an inner flap panel having an inner panel portion affixed to said central panel and an inner sealing flap hinged to said inner panel by a score line generally aligned with the remaining opposed edge of said central panel, said outer sealing flap being larger than said inner sealing flap whereby said inner sealing flap underlies said outer sealing flap when said outer sealing flap is adhered to said front panel, said inner sealing flap being adapted to be folded over and against said front panel and adhered directly thereto for resealing said envelope after said outer sealing flap has been opened and removed from said envelope, said outer sealing flap defining an opening which is adapted to provide communication between suction means of said automatic inserting machine and said inner sealing flap to permit said suction means to open both the inner and outer sealing flaps when the flaps are unsealed during automatic insertion of the contents to be placed in said envelope by said automatic inserting machine.

2. The resealable envelope as recited in claim 1, and transparent film means adhered to said front panel and covering said window for protecting the contents of said envelope.

3. The resealable envelope as recited in claim 1, wherein said hinge for the outer sealing flap includes perforations to facilitate removal of the outer sealing flap from the central panel.

* * * * *